US005580693A

United States Patent [19]

Nakajima et al.

[11] Patent Number: 5,580,693

[45] Date of Patent: Dec. 3, 1996

[54] LIGHT-HEAT CONVERTING TYPE HEAT MODE RECORDING PROCESS WHEREIN THE RECORDING MATERIAL COMPRISES A DEFORMABLE LAYER, WHILE THE INK LAYER OR THE IMAGE RECEIVING LAYER CONTAINS A MATTING AGENT

[75] Inventors: Atsushi Nakajima; Shinji Matsumoto; Katsumi Maejima; Sota Kawakami; Shozo Kikugawa, all of Hino, Japan

[73] Assignee: Konica Corporation, Japan

[21] Appl. No.: 68,749

[22] Filed: May 28, 1993

[30] Foreign Application Priority Data

| | | | |
|---|---|---|---|
| Jun. 3, 1992 | [JP] | Japan | 4-142799 |
| Aug. 27, 1992 | [JP] | Japan | 4-228778 |
| Aug. 27, 1992 | [JP] | Japan | 4-228779 |

[51] Int. Cl.[6] ..... G03C 7/00

[52] U.S. Cl. ..... 430/200; 430/201; 430/256; 430/945; 503/227

[58] Field of Search ..... 430/200, 201, 430/256, 257, 254, 253, 945; 503/227

[56] References Cited

U.S. PATENT DOCUMENTS

| | | | |
|---|---|---|---|
| 5,089,372 | 2/1992 | Kirihata et al. | 430/200 |
| 5,275,912 | 1/1994 | Riley | 430/200 |
| 5,278,576 | 1/1994 | Kaszczuk et al. | 430/201 |
| 5,300,398 | 4/1994 | Kaszczuk | 430/200 |

FOREIGN PATENT DOCUMENTS

| | | | |
|---|---|---|---|
| 454083 | 10/1991 | European Pat. Off. | B41M 5/34 |
| 466336 | 1/1992 | European Pat. Off. | B41M 5/40 |
| 529537 | 3/1993 | European Pat. Off. | B41M 5/38 |

OTHER PUBLICATIONS

Patent Abstracts of Japan, vol. 12, No. 346 (M–742); Sep. 16, 1988 JPA–63–104881; May 10, 1988.

Patent Abstracts of Japan, vol. 12, No. 478 (M–775); Dec. 14, 1988 JPA–63–199,681; Aug. 18, 1988.

*Primary Examiner*—John S. Y. Chu

*Attorney, Agent, or Firm*—Jordan B. Bierman; Bierman and Muserlian

[57] ABSTRACT

Disclosed is a light-heat converting type heat mode recording process using a recording material and an image receiving material, which comprises the steps of:

(a) transferring an ink image from a recording material to an image receiving material by exposing from a back of the recording material or the receiving material; and (b) transferring the ink image from the image receiving material to a final recording medium by applying heat or pressure.

The light-heat converting type heat mode recording material and the light-heat converting type heat mode image receiving material are capable of forming excellent transferred images.

12 Claims, 6 Drawing Sheets

LIGHT-HEAT CONVERTING TYPE HEAT MODE RECORDING PROCESS WHEREIN THE RECORDING MATERIAL COMPRISES A DEFORMABLE LAYER, WHILE THE INK LAYER OR THE IMAGE RECEIVING LAYER CONTAINS A MATTING AGENT

FIELD OF THE INVENTION

The present invention relates to a light-heat converting type heat mode recording process that forms an image by utilizing light. More particularly, it is concerned with a material, and a recording process, capable of forming a highly detailed and/or full-color image by a digital dry process.

BACKGROUND OF THE INVENTION

As conventional thermal transfer recording, there is a method in which a thermal transfer ink sheet comprising a substrate and provided thereon a thermomelting colorant layer or a colorant layer containing a sublimation dye is put face-to-face to a recording medium, and a heat source controlled by electrical signals given from a thermal head, an electrifying head or the like is brought into pressure contact with them from the side of the ink sheet to record an image by transfer. The thermal transfer recording has the features that it is noiseless, can be maintenance-free, is low in cost, can provide color images with ease and capable of performing digital recording, and is utilized in many fields of printers, recorders, facsimile systems and computer terminals.

Meanwhile, in recent years, in the field of medical treatment, printing and so forth, it is sought to provide recording processes feasible for what is called digital recording that can achieve a higher resolution and can process images at a high speed.

However, in conventional thermal transfer recording making use of a thermal head or an electrifying head as a heat source, it is difficult to make density higher, in view of the lifetime of head heating elements. To solve this problem, thermal transfer recording making use of a laser as a heat source is proposed in Japanese Patent Publications Open to Public Inspection [hereinafter referred to as Japanese Patent O.P.I. Publication(s)] No. 15437/1974, No. 17743/1974, No. 87399/1982 and No. 143659/1984.

In the thermal transfer recording making use of a laser as a heat source, resolution can be made higher by making a laser spot narrower. In the case when the recording is performed using a laser, it is common to carry out scanning recording. The scanning recording, however, has the disadvantage that its recording speed is lower than the recording speed achievable by the batch exposure making use of a masking material or the recording process making use of a line head. In order to increase the recording speed, it becomes necessary to increase scanning speed.

Methods for the scanning of laser beams include what is called plane scanning, in which primary scanning of laser beams is carried out using a polygonal mirror or galvanic mirror and an f-θ lens in combination and a secondary scanning is carried out while moving a recording medium, and cylindrical scanning, in which primary scanning is carried out while rotating a drum and secondary scanning is carried out by moving a laser beam. The cylindrical scanning is suited for heat mode recording because of its less energy loss in optical systems and capability of high-density recording. In this case, it is easy to increase scanning speed by increasing the rotational speed of the drum, but it is difficult to attain a close contact between a thermal transfer material and a recording material, which is necessary for the transfer. In the thermal transfer recording making use of a thermal head, it is possible to attain a close contact between a thermal transfer material and a recording material by virtue of the pressure acting between a platen and a thermal head heating element. In the cylindrical scanning, however, such a method can not be taken. Japanese Patent O.P.I. Publication No. 112665/1986 discloses that laser exposure is carried out while applying a pressure by means of a transparent pressing member. When, however, the drum is rotated at a high speed to carry out high-speed recording, it becomes difficult to apply a uniform pressure, tending to cause fogging due to contact uneveness or pressure transfer.

Meanwhile, a thermal transfer recording material comprising a support and having thereon an intermediate layer and an ink layer is proposed for the purpose of improving the contact between a recording material and an image receiving material, or for other reasons. For example, Japanese Patent O.P.I. Publication No. 225795/1985 discloses that a rubber type resin layer with a Young's modulus of $1.0\times10^8$ $Nm^{-2}$ at 50° C. is provided in a thickness of 5 μm or less between a support and a thermomelting colorant layer, whereby good printing can be carried out using a thermal head on sheets of paper including those with a high smoothness and those with a low smoothness.

Japanese Patent O.P.I. Publication No. 36698/1982 also discloses a thermal transfer sheet in which a resin layer comprised of polyvinyl butyral or epoxy, for improving adhesion between a support and an ink layer, is provided in a thickness of from 1 to 3 μm as an intermediate layer to make cohesive failure readily take place in the ink layer so that the sheet can be used many times.

Japanese Patent O.P.I. Publication No. 138984/1982 further discloses a technique in which an adhesive layer comprised of a thermomelting polyamide and carbon black is provided in a thickness of 6 μm as an intermediate layer so that only ink components can be permeated in and transferred to a recording paper without separation of an ink layer from the ink ribbon and printing can be repeatedly carried out. Japanese Patent O.P.I. Publication No. 116193/1983 discloses a technique concerned with a manufacturing process in which as an intermediate layer an adhesive layer similarly comprised of a thermomelting polyamide and carbon black is coated and dried followed by heating and then an ink layer is provided, which makes it possible to obtain an ink ribbon that can achieve a high printing density without causing separation of the ink layer from the support even when the intermediate layer has a smaller thickness. Japanese Patent O.P.I. Publication No. 109897/1985 discloses a technique in which a 1 to 2 μm thick intermediate layer and a 2 to 4 μm thick ink layer are provided on a 3 to 5 μm thick PET film, where a rubber type latex or a synthetic rubber material is used in the intermediate layer, so that good printing can be performed even on a recording paper with a smoothness of from 100 to 300 seconds.

All of these techniques are clearly different from the technique for obtaining a good contact performance under a contact pressure (1.0 $kg/cm^2$ at maximum) as weak as that in pressure reducing as intended in the present invention, and hence their inventive constitution is also different from the constitution of the present invention.

Japanese Patent O.P.I. Publications No. 144394/1986, No. 258793/1986, No. 279582/1986, No. 151393/1987, No. 5885/1989, No. 26497/1989 and so forth also disclose techniques concerning an image receiving medium having a cushioning layer between a support and an image receiving material. These, however, all relate to thermal transfer of a sublimation dye and also the heating is carried out by a thermal head. In addition, they are techniques applicable in instances in which an image once having been formed on an image receiving material is not required to be further transferred to a final recording medium. Hence, the techniques disclosed in these publications are different from the technique of the present invention.

SUMMARY OF THE INVENTION

An object of the present invention is to provide a light-heat converting type heat mode recording material that can well achieve close contact by vacuum contact, promises excellent transport performance and enables high-speed recording with a good transfer performance, and also provide a light-heat converting type heat mode image receiving material and a light-heat converting type heat mode recording process.

Another object of the present invention is to provide, in a laser thermal transfer recording system, a sheet contacting method that can achieve contact between a recording sheet and an image receiving sheet in a short time and can obtain a good transferred image, and a recording sheet and an image receiving sheet which are preferably used in such a recording system.

The above object of the present invention can be achieved by the following constitution.

(a) A light-heat converting type heat mode recording material used in heat mode recording carried out by putting a light-heat converting type heat mode recording material and a light-heat converting type heat mode image receiving material together in such a manner that the former's surface having an ink layer is put face-to-face to the latter's image receiving surface, and exposing them to light corresponding with image information to transfer the ink layer to the image receiving surface; wherein said light-heat converting type heat mode recording material comprises a support and provided thereon an intermediate layer and an ink layer.

(b) A light-heat converting type heat mode image receiving material used in light-heat converting type heat mode recording carried out by bringing a light-heat converting type heat mode recording material into contact with a light-heat converting type heat mode image receiving material, or putting them adjacently to each other, so as for the former's surface having an ink layer to face the latter's surface having an image receiving layer, and, in that state, exposing them to light corresponding with image information to carry out recording; wherein said light-heat converting type heat mode image receiving material comprises a support and provided thereon a deformable layer.

(c) A light-heat converting type heat mode recording process comprising the steps of putting a light-heat converting type heat mode image receiving material and a light-heat converting type heat mode recording material together so as for the former's deformable layer side surface to face the latter's ink layer surface, exposing them to light corresponding with image information, from the back of the light-heat converting type heat mode recording material or light-heat converting type heat mode image receiving material to transfer the ink layer corresponding with the image information, to the image receiving surface of the light-heat converting type heat mode image receiving material, and thereafter putting the light-heat converting type heat mode image receiving material having supported the ink layer thereon and a final recording medium together so as for the former's image receiving surface to face the latter's recording surface, to further transfer the ink layer on the image receiving surface to the surface of a final recording medium while applying heat and/or pressure.

In preferred embodiments, which are more effective for achieving the present invention, the above intermediate layer of the light-heat converting type heat mode image receiving layer has an elasticity modulus of 250 kg/mm$^2$ or less at 25° C., the intermediate layer thereof has a glass transition temperature of 80° C. or below, the intermediate layer thereof has a glass transition temperature of 80° C. or below, the intermediate layer thereof has a penetration as defined below of 15 or more, and the intermediate layer thereof has a layer thickness of 5 μm or more.

The penetration is measured by an apparatus in FIG. 7 and a method both similar to those applied for measuring the penetration degree of petroleum asphalt. In the method a metal needle having a specified dimensions shown in FIGS. 8*a* and 8*b* is used. To the surface of a block of the material for cushion layer, the needle is perpendicularly touched at the point of it with no loading. Then a load of 100 gram is added to the needle. After standing for 5 minutes, sinking distance of the needle caused by the loading is measured by a dial gauge equipped with the needle. During the measurement, the temperature of the sample is maintained at 25° C. The penetration degree is expressed by a value of ten times of the sinking distance by mm, for instance, the penetration is expressed as 1 when the sinking distance is 0.1 mm. Concerning the detail of measuring apparatus, JIS K 2530 and JIS K 2808 can be referred.

In other preferred embodiments, which are also more effective for achieving the present invention, the above deformable layer of the light-heat converting type heat mode image receiving material has an elasticity modulus of 200 kg/mm$^2$ or less at 25° C., the deformable layer thereof has a viscosity of 10,000 cp or less at 200° C., the deformable layer thereof has a glass transition temperature of 80° C. or below, the deformable layer thereof has a penetration as defined of 15 or more, and the deformable layer and/or the image receiving layer contain(s) a colorant capable of absorbing heat radiation.

The above object of the present invention can also be achieved by the following.

(1) A sheet contacting method comprising bringing a recording sheet into contact with an image receiving sheet, wherein the two sheets are exposed to light while bringing them into vacuum contact by means of a suction pump.

(2) An image receiving sheet comprising a thermoplastic layer or elastic layer capable of being deformed by application of heat, having a light-heat converting agent capable of converting light into heat.

Figure 2:
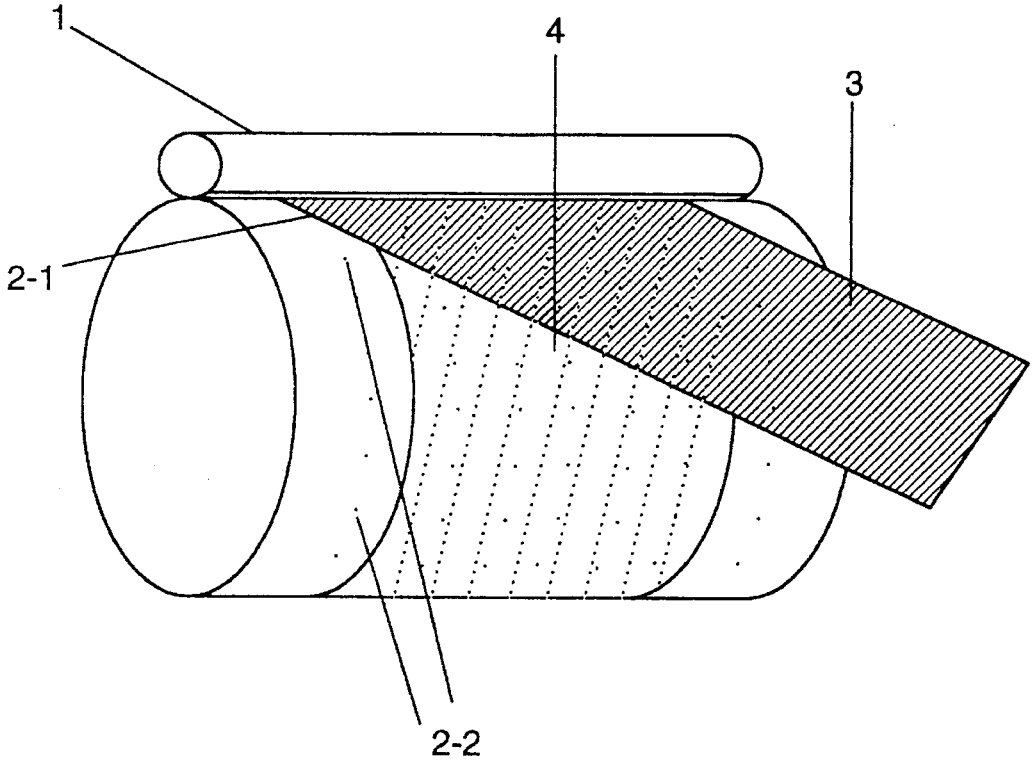

(1) image receiving sheet (2) ink sheet (3) drum (4) hole for pressure reducing (5) a direction of pressure reducing FIG. 2 schematically illustrates how the light-heat converting type heat mode image receiving material and recording material are wound around a drum type pressure reducing device.

Figure 3:
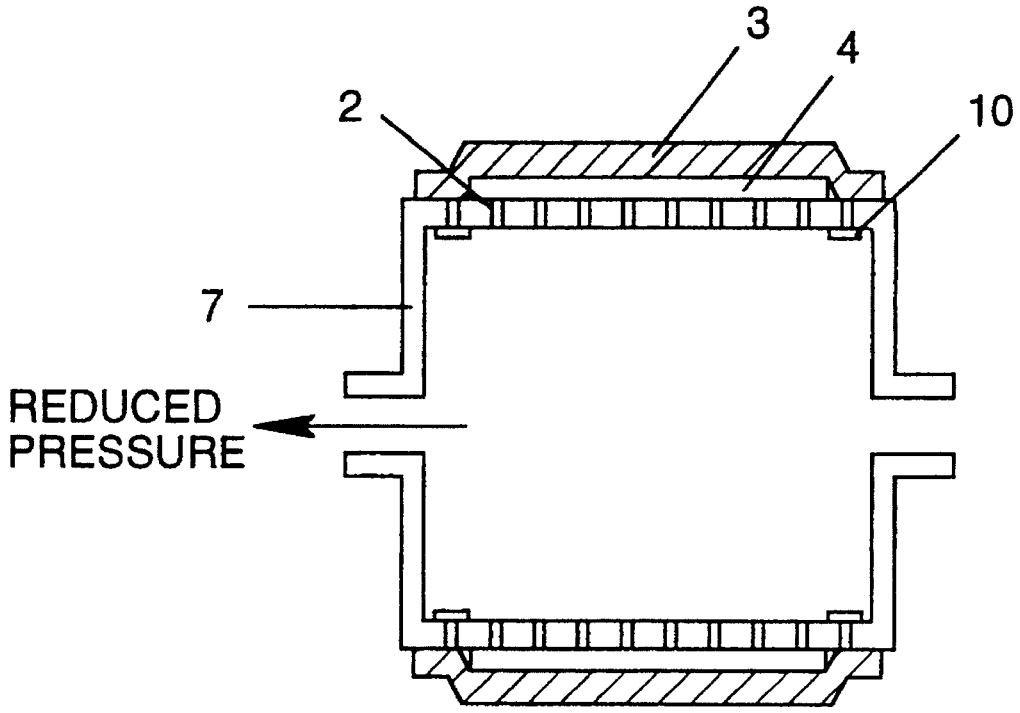

FIG. 3 cross-sectionally illustrates the basic structure of the drum type pressure reducing device.

Figure 4:
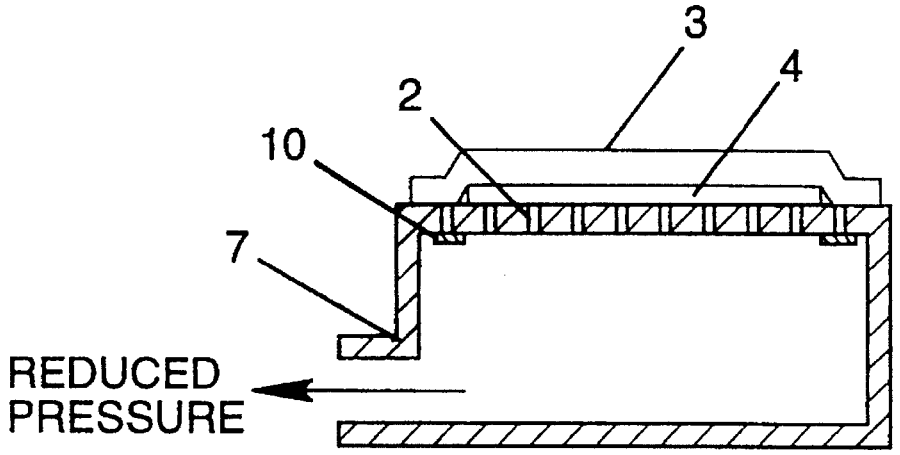

FIG. 4 cross-sectionally illustrates how the image receiving material and recording material are brought into contact with each other using a flat plate type pressure reducing device.

Figure 5:
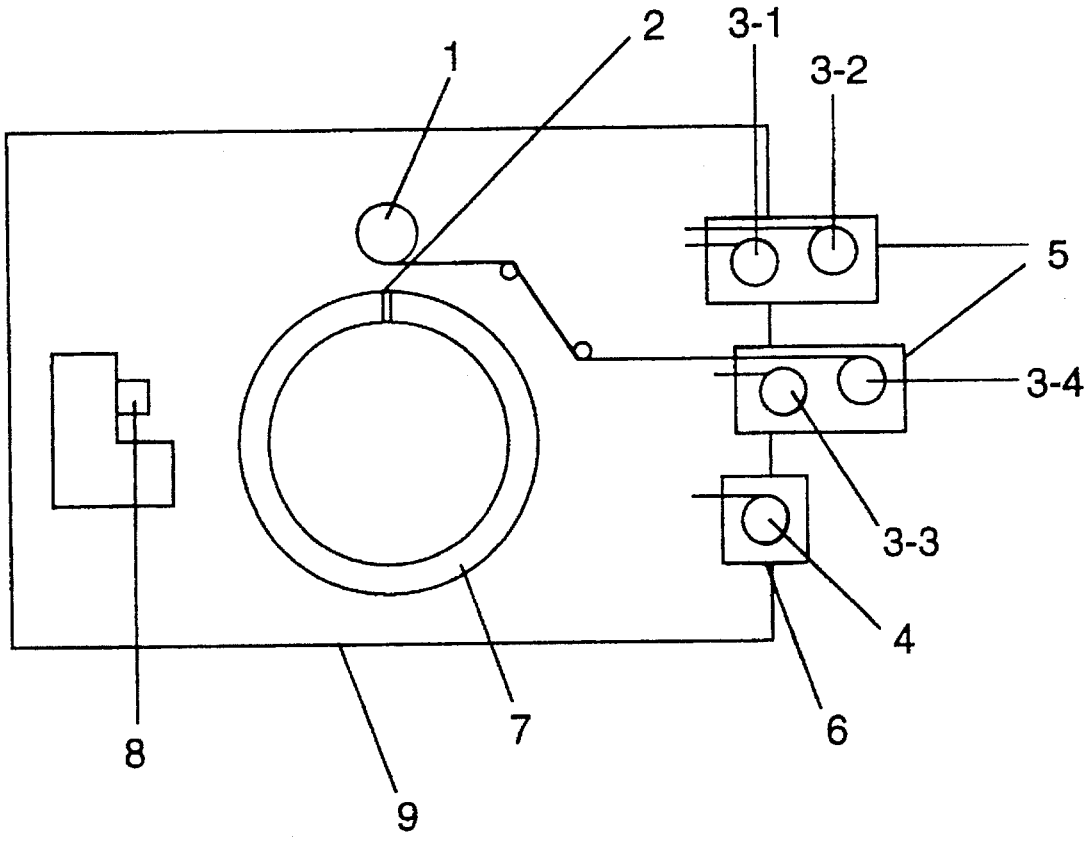

FIG. 5 illustrates the whole construction showing the drum type pressure reducing device and the surroundings of the pressure reducing device.

Figure 6:
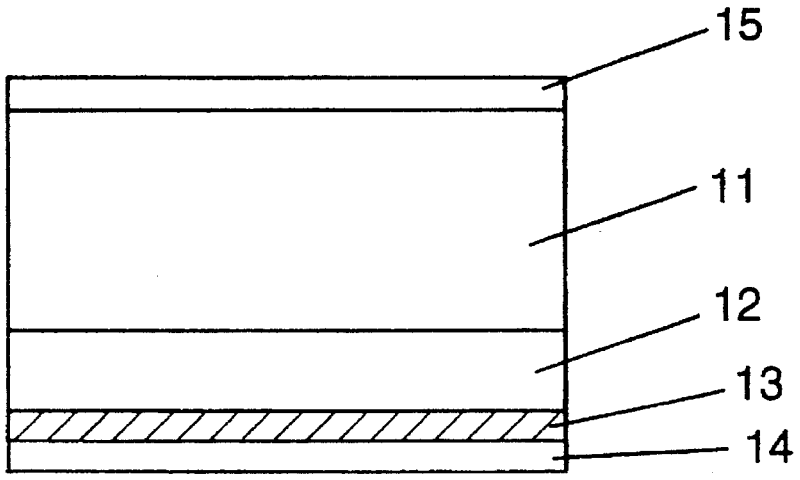
Figure 6:
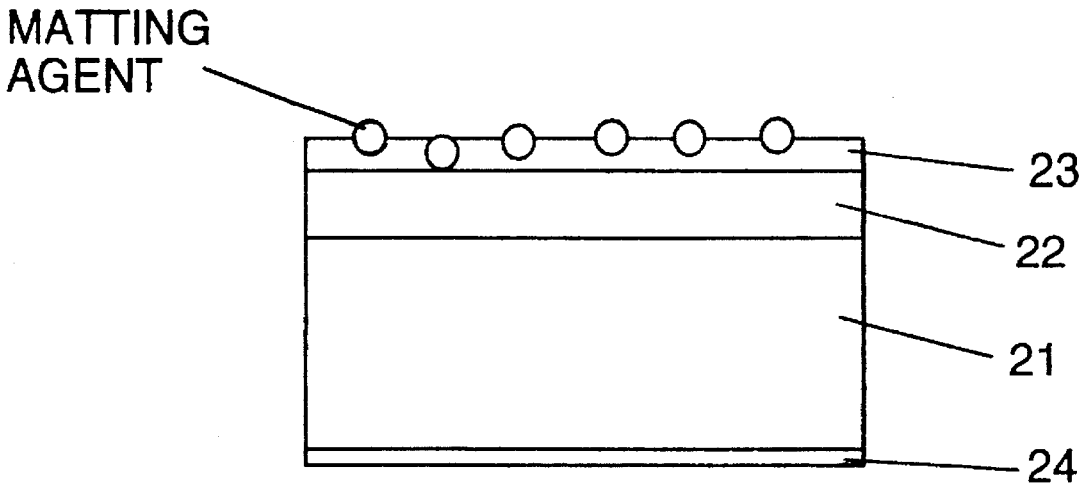

FIG. 6 cross-sectionally illustrates an example of the layer structure of the light-heat converting type heat mode recording material and image receiving material of the present invention.

In FIG. 2 to FIG. 6, reference numerals denotes as follows:

1, a pressure roll;

2, pressure reducing openings, where 2-1 denotes a state they are opened, and 2-2 a state they are closed;

3, a heat mode recording material, where 3-1 denotes a yellow recording material, 3-2 a magenta recording material, 3-3 a cyan recording material, and 3-4 a black recording material;

4, a heat mode image receiving material;

5, heat mode recording material supply means;

6, a heat mode image receiving material supply means;

7, a pressure reducing device holding portion;

8, an optical writing means;

9, a housing;

10, pressure reducing valves;

11 and 21, supports;

12, an intermediate layer;

22, a cushioning layer;

13, a light-heat converting layer;

14, an ink layer;

15 and 24, back coat layers (optional); and

23, an image receiving layer.

Figure 7:
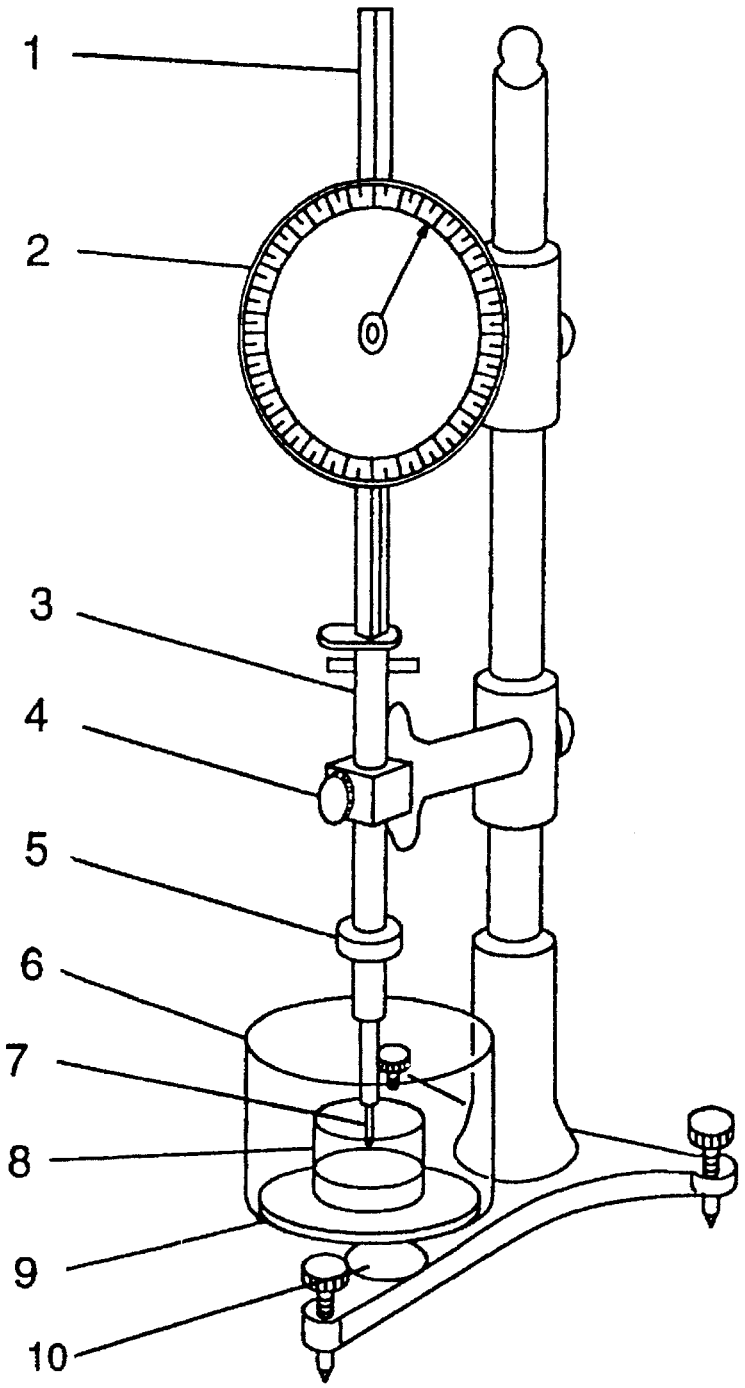

FIG. 7 testing instrument for penetration.

Figure 8A:
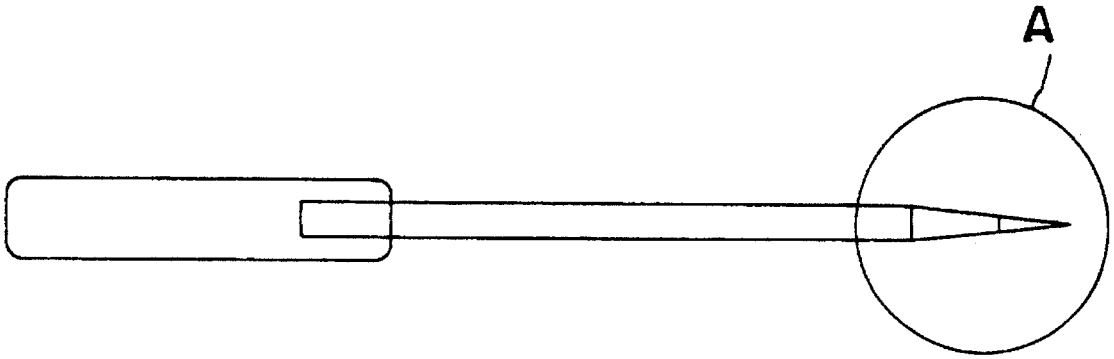

FIG. 8*a* metal needle of testing instrument.

Figure 8B:
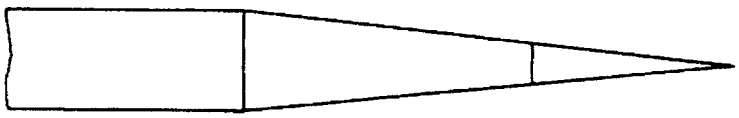

FIG. 8*b* metal needle of testing instrument.

DETAILED DESCRIPTION OF THE INVENTION

The present invention will be described below in detail. In the following description, the light-heat converting type heat mode image receiving material, recording material and recording process are often respectively abridged "the heat mode image receiving material, recording material and recording process" and further "the image receiving material, recording material and recording process".

In general, when the recording material and the image receiving material are brought into contact by vacuum contact, it is difficult for them to be brought into perfectly close contact. Hence, when exposed to light to carry out printing, poor transfer due to poor contact tends to occur.

Studies made by the present inventors have revealed that use of a recording material comprising a support that can have sufficient cushioning properties attributable to heat energy converted when exposed to light and an ink layer formed thereon makes it possible to obtain good transferred images free from blank areas even when no perfect contact is achieved between the recording material and the image receiving material. This is considered due to the support having cushioning properties attributable to heat generated when exposed to light, which contributes the achievement of close contact necessary for the transfer.

However, such a support that can have sufficient cushioning properties attributable to heat energy converted when exposed to light can be a material having an insufficient rigidity and at the same time having not a good lubricity, making it difficult to be automatically transported through the inside of a recording apparatus. In order to improve transport performance, one may contemplate to make the layer thickness of the support larger. In the support having sufficient cushioning properties, however, it is difficult to achieve the rigidity for attaining the transport performance, by only making the thickness larger. Now, as a result of studies, it has been made clear that in the contact by vacuum contact it is preferable for the recording material to have a support having a rigidity so that it can have a rigidity and also to have an intermediate layer with cushioning properties so that it can have cushioning properties.

It is also preferable for this intermediate layer with cushioning properties to be deformable in such a way that any foreign matter can be embedded on the occasion that the foreign matter has been caught between the recording material and the image receiving material when they are put together. This makes it possible to prevent any faulty images from occurring at that part even when the foreign matter is present.

Employment of such construction has been found to enable achievement of both the contact performance necessary for the transfer during exposure (to shorten the pressure reducing time for achieving the contact performance) and the transport performance. Thus the present invention has been accomplished.

In the meantime, studies made by the present inventors have also revealed that use of the image receiving material having an image receiving layer formed on the support having a sufficient elasticity brings about an improvement in contact performance between the recording material and the image receiving material and makes it possible to obtain good images free from blank areas. This can be considered due to the support having a deformability, which contributes the achievement of the close contact necessary for the transfer. However, in the material in which the support itself is deformable in this way, the support may have an insufficient strength and dimensional stability and it has been difficult to form images in a high precision.

Further studies now made by them have revealed that an image receiving material provided with a suitable deformable layer to have a deformability can bring about an improvement in contact performance. In the case when the image receiving material and a transfer material such as art paper, coated paper or woodfree paper are put together to further transfer the image formed on the former, to the latter while applying heat and/or pressure, to obtain a final image, no sufficient contact can be achieved because of undulation on the surface of the paper to which the image is being further transferred, causing blank areas or break-off in the transferred image, unless the image receiving material has no deformable layer. Thus, it has been made clear that the image can be transferred to the final recording medium when the deformable layer of the image receiving material is made to have a sufficiently large thickness.

The deformable layer of the image receiving material may preferably have a good adhesion, and be deformable to such an extent that it can well follow up the undulation of the final recording medium such as art paper, coated paper or wood-free paper when the image is further transferred thereto.

This deformable layer may also preferably be so formed that any foreign matter can be embedded on the occasion that the foreign matter has been caught between the recording material and the image receiving material when they are put together. This makes it possible to prevent any faulty images from occurring at that part even when the foreign matter is present.

The image receiving material is also required to have a certain degree of rigidity so that materials can be automatically transported through the inside of apparatus and can be automatically wound up to a holding member that holds the recording material and the image receiving material. For this purpose, it is preferable for the support itself of the image receiving material to have a rigidity, as in the case of the recording material.

As a result of the studies thus made, it has been made clear that the satisfaction of any of the above requirements enables achievement of the object of the present invention.

A typical process of light-heat converting type heat mode recording will be described below with reference to the accompanying drawings.

Figure 1:
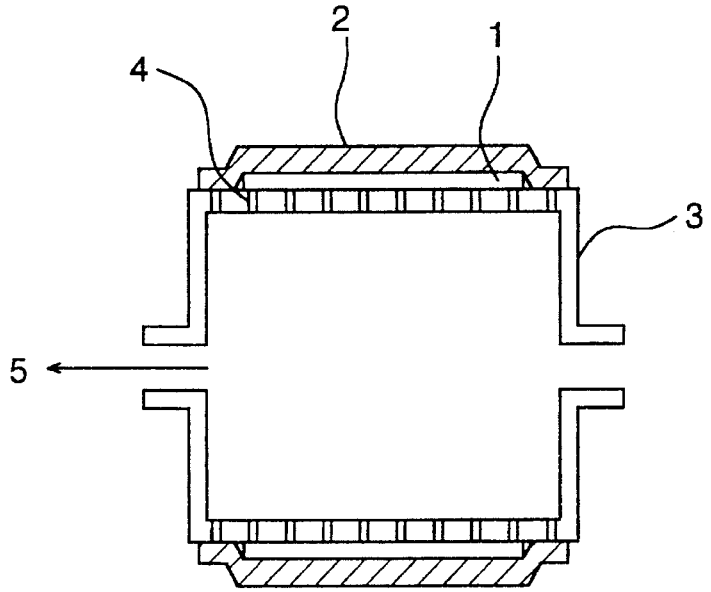
FIG. 1 schematically illustrates the vacuum contacting method by pressure reducing.

As a contacting method, as shown in FIG. 1, the image receiving layer surface of an image receiving material and the ink layer surface of a recording material having a larger length and breadth than the image receiving material are put face-to-face and superposed on a pressure reducing device having minute openings, and the pressure is reduced through the minute openings to attract the recording material at its part extending over the external boundary of the image receiving material so that the image receiving material and the recording material are brought into contact with each other. Alternatively, in reverse the ink layer surface of a recording material and the image receiving layer surface of an image receiving material having a larger length and breadth than the recording material are put face-to-face, and the pressure is reduced through the minute openings to attract the image receiving material extending over the external boundary of the recording material so that the recording material and the image receiving material are brought into contact.

This contacting method makes it easy to automate both the transport and the winding-up of the recording material and image receiving material and makes it possible to carry out heat mode recording by exposing them to light after the contacting has been completed. The pressure reducing device may be of a drum type as shown in FIG. 2 or a flat plate type as shown in FIG. 3. In instances in which high-speed recording is required, the cylindrical scanning making use of the drum type pressure reducing device is better than the plane scanning making use of the flat-plate type pressure reducing device and a polygonal mirror or galvanic mirror, because of a smaller loss of optical systems.

Using such a pressure reducing device, the ink layer surface of the recording material and the image receiving layer surface of the image receiving material are brought into contact or put them adjacently to each other (this state is called a contact state), in the state of which they are exposed to light corresponding with image information, to carry out thermal transfer recording.

FIG. 4 shows the pressure reducing device used in the present invention and the surroundings of the pressure reducing device.

Here is illustrated an instance in which the pressure reducing device is of a drum type. There is no change in the basic construction also when it is of a flat plate type. For example, in an instance in which a recording material and an image receiving material each having the structure as shown in FIG. 5 are brought into contact by winding them around the pressure reducing device, the image receiving material is first wound around it and secured thereto by reducing the pressure in the state that pressure reducing valves are closed. Next, the recording material is wound around on it. At this time, it is wound around while the pressure reducing valves are successively opened. This makes it easy to shorten the pressure reducing time and obtain the state of close contact. It is more effective to open the pressure reducing valves while pressing the materials by means of a squeegee roll.

The recording material and image receiving material used in the present invention will be described below.

The recording material of the present invention has a basic structure wherein an intermediate layer and an ink layer are laminated to a support and at the same time has the function of converting light of imagewise exposure into heat.

The support may be any of those having a rigidity, having a good dimensional stability and durable to heat at the time of image formation. Stated specifically, films or sheets as disclosed in Japanese Patent O.P.I. Publication No. 193886/1988, left lower column, lines 12–18 can be used. When images are formed by exposure to laser light from the recording material side, the support of the recording material should be transparent. When images are formed by exposure to laser light from the image receiving material side, the support of the recording material need not be transparent. The support may preferably have a layer thickness of from 6 to 200 μm, and more preferably from 25 to 100 μm.

As the intermediate layer of the present invention, it is preferable to use those having an elasticity modulus of 1 $kg/mm^2$ or more to 250 $kg/mm^2$ or less, and more preferably 2 $kg/mm^2$ or more to 150 $kg/mm^2$ or less, and a Tg of −100° C. or above to 80° C. or below, and more preferably −80° C. or above to 40° C. or below.

The intermediate layer with cushioning properties has a penetration of 15 or more to 500 or less, and more preferably 30 or more to 300 or less.

Materials having such properties may be those selected from the following, to which, however, the materials are by no means limited. They may specifically include natural rubber, acrylate rubber, butyl rubber, nitrile rubber, butadiene rubber, isoprene rubber, styrene-butadiene rubber, chloroprene rubber, urethane rubber, silicone rubber, acrylic rubber, fluorine rubber, neoprene rubber, chlorosulfonated polyethylene, epichlorohydrin, EPDM (ethylene-propylene-diene rubber), elastomers such as urethane elastomer, polyethylene, polypropylene, polybutadiene, polybutene, impact-resistant ABS resin, polyurethane, ABS resin, acetate, cellulose acetate, amide resin, polytetrafluoroethylene, nitrocellulose, polystyrene, epoxy resin, phenol-formaldehyde resin, polyester, impact-resistant acrylic resin, a styrene/butadiene copolymer, an ethylene/vinyl acetate copolymer, an acrylonitrile/butadiene copolymer, a vinyl chloride/vinyl acetate copolymer, polyvinyl acetate, plasticizer-containing vinyl chloride resin, vinylidene chloride resin, polyvinyl chloride, and polyvinylidene chloride, among which resins having a low elasticity modulus are available.

As the intermediate layer with cushioning properties, a shape memory resin such as styrene type hybrid polymers wherein polynorbornene or polybutadiene units and polystyrene units have been complexed can be used.

The intermediate layer that meets the preferable requirements of the present invention can not necessarily be defined on the basis of the types of component materials. Those having preferable properties in component materials themselves may further include the following: An ethylene/vinyl acetate copolymer, an ethylene/ethyl acrylate copolymer, polybutadiene resins, a styrene/butadiene copolymer (SBR), a styrene/ethylene/butadiene copolymer (SEBS), an acrylonitrile/butadiene copolymer (NBR), polyisoprene resins (IR), a styrene/isoprene copolymer (SIS), acrylate copolymers, polyester resins, polyurethane resins, butyl rubber, and polynorbornene.

Of these, those having a relatively low molecular weight can readily meet the requirements of the present invention, but can not necessarily be limited in relation to component materials.

Even component materials other than the foregoing can provide preferable properties to the intermediate layer by adding various additives.

Such additives may include low-melting substances such as waxes. Specifically stated, they may include phthalates, adipates, glycolates, fatty acid esters, phosphates and chlorinated paraffins. It is also possible to add various additives disclosed in "Practical Handbook of Plastic and Rubber Additives", Kagaku Kogyosha Co. (published 1970).

Any of these additives may be added in an amount so selected as to be necessary for achieving the properties of the present invention in combination with the basic intermediate layer component material, without any particular limitations, but, in general, preferably in an amount of not more than 10% by weight, and more preferably not more than 5% by weight, based on the weight of the intermediate layer component material.

As a method-for forming the intermediate layer, a composition prepared by dissolving the above component in a solvent or dispersing them in the form of a latex may be coated by blade coating, roll coating, bar coating, curtain coating, gravure coating or the like. Hot-melt extrusion lamination, cushioning film lamination, etc. may also be used.

The intermediate layer is required to have a layer thickness of 5 μm or more so that it can be well brought into close contact with the image receiving material, and more preferably 10 μm or more. In order for the intermediate layer to be deformable in such a way that any foreign matter can be embedded to prevent faulty images on the occasion that the foreign matter has been caught between the recording material and the image receiving material, the intermediate layer may still more preferably have a layer thickness of 20 μm or more.

In the light-heat converting type heat mode recording (hereinafter also "heat mode recording"), the energy loss due to heat conduction from the ink layer to the support side can be decreased by making exposure time shorter. In the heat mode recording, the heat energy imparted to layers other than the ink layer is smaller than that in usual thermal transfer recording wherein a thermal head is used and the ink layer is heated by the heat conduction from the support side. Hence, it is considered necessary for the intermediate layer to have sufficient cushioning properties on account of the heat energy produced in the ink layer at the time of exposure. This slight quantity of heat brings about a lowering of elasticity modulus or a softening by heat, and hence the resin constituting the intermediate layer may preferably have a Tg of 80° C. or below, and more preferably 40° C. or below. In order for the foreign matter caught between the recording material and the image receiving material to be embedded, the intermediate layer may preferably have cushioning properties at room temperature, and a Tg of 20° C. or below, and still more preferably 0° C. or below.

In order for the energy of a light source for the heat mode recording to be absorbed in the ink layer without loss, the transmittance of light through the support and intermediate layer with respect to wavelength of the light source may preferably be not less than 70%, and more preferably not less than 80%. For this purpose, it is necessary to use a support and an intermediate layer each having a good transparency and also to decrease reflection at the back coat side of the support and at the interface between the support and the intermediate layer.

As a method for decreasing the reflection at the interface between the support and the intermediate layer, the intermediate layer may be made to have a refractive index smaller by at least 0.1 than that of the support, so that the light energy loss due to interfacial reflection can be greatly decreased.

The ink layer may be a transfer layer comprising a colorant, a light-heat converting agent and a binder, or may have a double-layer structure comprised of a transfer layer comprising a colorant layer and a binder and a non-transferring light-heat converting layer comprising a light-heat converting agent and a binder.

First, the embodiment in which the ink layer is a transfer layer capable of causing light-heat conversion will be described.

The colorant mentioned above may include pigments as exemplified by inorganic pigments and organic pigments, and dyes.

The inorganic pigments may include titanium oxide, carbon black, zinc oxide, Prussian blue, cadmium sulfide, iron oxide, and chromates of lead, zinc, barium and calcium.

The organic pigments may include pigments of an azo type, a thioindigo type, an anthraquinone type, an anthanthrone type and a triphenodioxazine type, vat dye pigments, phthalocyanine pigments (as exemplified by copper phthalocyanine) and derivatives thereof, and quinacridone pigments. The organic dyes may include acid dyes, direct dyes, disperse dyes, oil-soluble dyes, metal-containing oil-soluble dyes, and sublimation dyes.

When an image formed is used as a color proof, pigments as exemplified by Lyonol Blue FG-7330, Lyonol Yellow No. 1206, No. 1406G and Lyonol Red 6BFG-4219X (all available from Toyo Ink Mfg. Co., Ltd.) can be used.

There are no particular limitations on the content of the colorant in the ink layer. The colorant may usually be in a content ranging from 5 to 79% by weight, and preferably from 10 to 60% by weight.

As the light-heat converting agent, any conventionally known agents can be used. Since in a preferred embodiment of the present invention the heat is generated by exposure to semiconductor laser light, a near infrared absorbent showing an absorption peak at a wavelength band of from 700 to 3,000 nm and having no or small absorption in the visible region is preferable when color images are formed. Carbon black or the like having an absorption in the regions of from the visible region to the infrared region is preferable when monochromatic images are formed.

As the near infrared absorbent, organic compounds such as dyes of a cyanine type, a polymethine type, an azulenium type, a squalium type, a thiopyrylium type, a naphthoquinone type and an anthraquinone type, and organic metal complexes of a phthalocyanine type, an azo type and a thioamide type are preferably used, specifically including the compounds disclosed in Japanese Patent O.P.I. Publications No. 139191/1988, No. 33547/1989, No. 160683/1989, No. 280750/1989, No. 293342/1989, No. 2074/1990, No. 26593/1991, No. 30991/1991, No. 34891/1991, No. 36093/1991, No. 36094/1991, No. 36095/1991, No. 42281/1991, No. 97589/1991, No. 103476/1991, etc.

These may be used alone or in combination of two or more kinds.

The binder in the ink layer may include thermomelting substances, thermosoftening substances and thermoplastic resins. The thermomelting substances are usually solid or semi-solid substances having a melting point within the range of from 40° to 150° C., measured using Yanagimoto MJP-2 Type. They may specifically include waxes as exemplified by vegetable waxes such as carnauba wax, Japan wax, auriculi wax and esparto wax; animal waxes such as bees wax, insect wax, shellac wax and sparmaceti; petroleum waxes such as paraffin wax, micrycrystalline wax, polyethylene wax, ester wax and acid wax; and mineral waxes such as montan wax, ozokerite and ceresine. Besides these waxes, they may also include higher fatty acids such as palmitic acid, stearic acid, margaric acid and behenic acid; higher alcohols such as palmityl alcohol, stearyl alcohol, behenyl alcohol, marganyl alcohol, myricyl alcohol and eicosanol; higher fatty acid esters such as cetyl palmitate, myricyl palmitate, cetyl stearate and myricyl stearate; amides such as acetamide, propionic acid amide, palmitic acid amide, stearic acid amide and amide wax; and higher amines such as stearylamine, behenylamine and palmitylamine.

The thermoplastic resins may include polymeric compounds as exemplified by resins such as ethylene copolymers, polyamide resins, polyester resins, polyurethane resins, polyolefin resins, acrylic resins, a styrene/acrylate copolymer, styrene resins, a styrene/maleic acid copolymer, vinyl chloride resins, cellulose resins, rosin resins, plolyvinyl alcohol resins, polyvinyl acetal resins, ionomer resins and petroleum resins; elastomers such as natural rubber, styrene-butadiene rubber, isoprene rubber, chloroprene rubber and diethylene copolymers; rosin derivatives such as ester gum, rosin maleic acid resin, rosin phenol resin and hydrogenated rosin; and aromatic hydrocarbon resins such as phenol resin, terpene resin and cyclopentadiene resin.

The above thermomelting substances and thermoplastic resins may be appropriately selected so that a thermal transfer layer having the desired thermosoftening point or thermomelting point can be formed.

Next, the embodiment in which the ink layer has the double-layer structure comprised of a transferring colorant layer and a light-heat converting layer will be described. The double-layer structure comprised of a colorant layer and a light-heat converting layer makes it possible to use a light-heat converting agent having an absorption in the visible region and is advantageous for color reproduction especially when color images are produced.

As the light-heat converting agent in the light-heat converting layer, those listed for the ink layer capable of causing light-heat conversion can be used. The light-heat converting layer has an absorption of at least 0.25, and preferably 0.5 or more, with respect to the wavelength of a light source in the near infrared region of 700 to 1,000 nm. Use of an infrared absorbing dye, which has a large coefficient of absorption per unit weight compared with the pigment such as carbon black, can allow to make the layer thickness of the light-heat converting layer smaller, so that the sensitivity can be made higher. Thus, its use is preferred.

As the binder in the light-heat converting layer, it is possible to use resins having a high glass transition point and a high thermal conductivity, as exemplified by gelatin and resins such as polyvinyl pyrrolidone, polyester, polyparabanic acid, polymethyl methacrylate, polycarbonate, polystyrene, ethyl cellulose, nitrocellulose, methyl cellulose, hydroxypropyl cellulose, polyvinyl alcohol, polyvinyl chloride, polyamide, polyimide, polyether imide, polysulfone, polyether sulfone, and aramid.

This light-heat converting layer may preferably have a layer thickness of from 0.1 to 3 μm. The content of the light-heat converting agent in the light-heat converting layer may be so determined as to give a light absorbance of 0.25 or more at the wavelength of a light source used in image recording.

The light-heat converting layer may otherwise be formed as a deposited film, which may include deposited films of carbon black or metal black such as aluminum, chromium, nickel, antimony, tellurium, bismuth or selenium as disclosed in Japanese Patent O.P.I. Publication No. 20842/1977. The light-heat converting agent may be the colorant itself of the ink layer. It is by no means limited to those described above, and various substances can be used.

The image receiving material will be described below.

The image receiving material receives the ink layer imagewise separated from the recording material described above, to form an image. The image receiving material of the present invention comprises a support and provided thereon a deformable layer and an image receiving layer.

The image receiving material should have an appropriate thermal strength and also have an excellent dimensional stability so that images can be properly formed.

As the support for the image receiving material, the same supports as those described for the recording material can be used. It may preferably have a layer thickness of from 25 to 200 μm, and more preferably from 25 to 100 μm.

The deformable layer may preferably have an elasticity modulus of 1 kg/mm$^2$ or more to 200 kg/mm$^2$ or less at 25° C., and more preferably 2 kg/mm$^2$ or more to 100 kg/mm$^2$ or less. The deformable layer may preferably have a melt viscosity of 10 cp or more to 10,000 cp or less at 200° C., and more preferably 20 cp or more to 5,000 cp or less. The deformable layer may preferably have a glass transition temperature of −100° C. or above to 80° C. or below, and more preferably −80° C. or above to 40° C. or below. The deformable layer may have a penetration of 15 or more to 500 or less, and more preferably 30 or more to 300 or less. The deformable layer may be made of the same component material as that of the cushioning layer of the recording material.

Preferable properties of the deformable layer of the present invention can not necessarily be defined on the basis of the types of component materials. Those having preferable properties in component materials themselves may include the following: An ethylene/vinyl acetate copolymer, an ethylene/ethyl acrylate copolymer, polybutadiene resins, a styrene/butadiene copolymer (SBR), a styrene/ethylene/butadiene copolymer (SEBS), an acrylonitrile/butadiene copolymer (NBR), polyisoprene resins (IR), a styrene/isoprene copolymer (SIS), acrylate copolymers, polyester resins, polyurethane resins, butyl rubber, and polynorbornene.

Of these, those having a relatively low molecular weight can readily meet the requirements of the present invention, but can not necessarily be limited in relation to component materials.

Even component materials other than the foregoing can provide preferable properties to the deformable layer by adding various additives.

Such additives may include low-melting substances such as waxes. Specifically stated, they may include phthalates, adipates, glycolates, fatty acid esters, phosphates and chlorinated paraffins. It is also possible to add various additives disclosed in "Practical Handbook of Plastic and Rubber Additives", Kagaku Kogyosha Co. (published 1970).

Any of these additives may be added in an amount so selected as to be necessary for achieving the properties of the present invention in combination with the basic deformable layer component material, without any particular limitations, but, in general, preferably in an amount of not more than 10% by weight, and more preferably not more than 5% by weight, based on the weight of the deformable layer component material.

As a method for forming the deformable layer, a composition prepared by dissolving the above component in a solvent or dispersing them in the form of a latex may be coated by blade coating, roll coating, bar coating, curtain coating, gravure coating or the like. Hot-melt extrusion lamination, cushioning film lamination, etc. may also be used.

The deformable layer may preferably have a layer thickness of not less than 10 μm, and more preferably not less than 20 μm. In the case when the ink layer is further transferred to other recording material, the deformable layer may more preferably have a layer thickness of not less than 30 μm. If the layer thickness of the deformable layer is less than 10 μm, blank areas or break-off may occur when further transferred to a final recording material.

The image receiving layer comprises a binder and various additives or matting agent optionally added. In some instances, it is formed only of a binder.

The image receiving layer binder having a good transfer performance may include adhesives such as a polyvinyl acetate emulsion type adhesive, a chloroprene type adhesive and an epoxy resin type adhesive, pressure-sensitive adhesives such as natural rubber and resins of a chloroprene type, a butyl rubber type, a polyacrylate type, a nitryl rubber type, a polysulfide type, a silicone rubber type, a rosin type and a petroleum type, reclaimed rubber, vinyl chloride resins, SBR, polybuadiene resin, polyisoprene, polyvinyl butyral resin, polyvinyl ether, ionomer resin, styrene resin, styrene-acrylic resin, and acrylic resin.

In the case when the image having been formed on the image receiving material is further transferred to other recording medium while applying heat and/or pressure, a resin having a relatively small polarity (having a small SP value) is particularly preferred for the image receiving layer. Such a resin is exemplified by polyethylene, polypropylene, an ethylene/vinyl chloride copolymer, an ethylene/acrylate copolymer, thylene-vinyl acetate resins (EVA), vinyl chloride graft EVA resins, vinyl chloride resins and various types of modified olefins.

The image receiving layer may usually have a layer thickness of from 0.5 to 10 μm. This does not necessarily apply to the case when the deformable layer is used as the image receiving layer.

As an exposure method, it is possible to use a method in which exposure is carried out from the support side of the recording material in the state that the recording material and the image receiving material are bought into close contact, and a method in which exposure is carried out through the image receiving material.

In the case when the exposure is carried out from the support side of the recording material, a colorant capable of absorbing heat radiation may be added to the image receiving material and/or the deformable layer so that the light having not been completely absorbed in the recording material can be absorbed in the image receiving material and/or the deformable layer, to effectively utilize the heat. This is effective for improving transfer performance.

In the latter case, in order for the energy of a light source to be absorbed in the ink layer without loss, the transmittance of light through the image receiving material with respect to wavelength of the light source may preferably be not less than 70%, and more preferably not less than 80%. For this purpose, it is necessary to use a support and an intermediate layer each having a good transparency and also to decrease reflection at the back coat side of the support and at the interface between the support and the deformable layer. As a method for decreasing the reflection at the interface between the support and the deformable layer, the deformable layer may be made to have a refractive index smaller by at least 0.1 than that of the support, so that the light energy loss due to interfacial reflection can be greatly decreased.

The material having a deformability may cause a decrease in lubricity as a result of deformation, often resulting in a poor lubricity between the image receiving material and the ink layer. As a result, it may become difficult to achieve contact in a large area, and may become difficult to automatically transport the materials in a recording apparatus. In such a case, as a countermeasure to be taken, an image receiving layer with a good lubricity may be provided as an upper layer of the deformable layer.

In order to obtain the image receiving layer with a good lubricity, (i) a matting agent may be added and (ii) an component material with a good lubricity may be used. (i) The addition of fine particles (a matting agent) to the image receiving material is effective for improving the lubricity of the recording material and image receiving material. However, addition of the matting agent in an excessively large amount may give formation of a gap between the recording material and the image receiving material, resulting in a poor transfer performance. The amount of the matting agent added depends on its particle diameter and the layer thickness of the image receiving layer. For example, in the case of a matting agent of 0.8 to 1.5 μm in particle diameter, it may be added in an amount of from 15 to 150 mg/m$^2$; in the case of a matting agent of 2.0 to 3.5 μm in particle diameter, from 15 to 150 mg/m$^2$; and in the case of a matting agent of 5 μm in particle diameter, not more than 10 mg/m$^2$.

(ii) The component with a good lubricity may include polyethylene resin, polypropylene resin, silicone resin and Teflon resin.

The ink sheet and image receiving sheet used in laser thermal transfer recording will be described below.

The ink sheet has a basic structure wherein at least a thermomelting ink layer is laminated to a support and at the same time has the function of converting light of imagewise exposure into heat. In some instances, a backing layer may be provided on the surface of the support on its side opposite to the side on which the thermomelting ink layer is provided, or a release layer may be provided between the support and the ink layer. A cushioning layer may also be provided between the support and the thermomelting ink layer, in the case of which the release layer may be provided between the cushioning layer and the ink layer.

The function of converting light of imagewise exposure into heat can be achieved, for example, by incorporating a light-heat converting agent into the ink layer or by providing adjacently to the ink layer a light-heat converting layer containing a light-heat converting agent.

The support may be any of those having a good dimensional stability and durable to heat at the time of image formation. Stated specifically, films or sheets as disclosed in Japanese Patent O.P.I. Publication No. 193886/1988, left lower column, lines 12–18 can be used. When images are formed by exposure to laser light from the ink sheet side, the support of the ink sheet should be transparent. When images are formed by exposure to laser light from the image receiving sheet side, the support of the ink sheet need not be transparent.

There are no particular limitations on the thickness of the support. It may preferably be from 2 to 300 μm, and more preferably from 5 to 200 μm.

On the back of the support.(the surface on the side opposite to the surface provided with the ink layer), a backing layer may be provided in order to impart running stability, thermal resistance and the function of antistatic. The backing layer can be formed, for example, by coating the surface of the support with a backing layer coating composition prepared by dissolving a resin such as nitrocellulose in a solvent or dissolving or dispersing a binder resin and fine particles of 20 to 30 μm in a solvent.

The light-heat converting layer may be provided adjoiningly to the ink layer. As previously mentioned, the light-heat converting agent may be incorporated into the ink layer. This light-heat converting layer need not particularly be provided.

The image receiving sheet will be described below.

The image receiving sheet receives the ink layer imagewise separated from the ink sheet described above, to form an image. Usually the image receiving sheet has a support and an image receiving layer, or may also be formed of the support itself.

To the image receiving sheet, the ink layer melted by heat is transferred, and hence the image receiving sheet should have an appropriate thermal strength and also have an excellent dimensional stability so that images can be properly formed.

The image receiving sheet has a good smoothness or has been appropriately roughed on its surface coming into touch with the opposing medium when images are formed. Stated more specifically, when the ink sheet has been roughed by a matting agent or the like on its surface of the ink layer, the surface coming into touch with the ink layer of the image receiving sheet should have a good smoothness. When on the other hand the ink layer of the ink sheet has not been surface-roughed, the surface coming into touch with the ink layer of the image receiving sheet should have been roughed. Both the surfaces at which the ink layer and the image receiving sheet come into touch with each other may have been roughed. The surface-roughing is effective for shortening the time required for vacuum contact and, in particular, for reducing pressure at the center area of the sheet. As a standard for the surface-roughing, it can be achieved by providing a matting agent of 1 to 20 μm in particle diameter to the surface coming into tough with the sheet. This, however, does not necessarily apply to the case where the contact for transfer may become faulty.

The image receiving layer may be formed of a binder, various additives optionally added and the above substance for imparting cushioning properties.

The binder may include adhesives such as an ethylene/vinyl chloride copolymer type adhesive, a polyvinyl acetate emulsion type adhesive, a chloroprene type adhesive and an epoxy resin type adhesive, pressure-sensitive adhesives such as natural rubber and resins of a chloroprene type, a butyl rubber type, a polybutadiene rubber type, a polyacrylate type, a nitryl rubber type, a polysulfide type, a silicone rubber type and a rosin type, vinyl chloride resins, petroleum resins and ionomer resin, reclaimed rubber, SBR, polyisoprene, and polyvinyl ether.

The cushioning layer that may be provided between the support and the image receiving layer corresponds to the cushioning layer described in regard to the ink layer of the recording material previously described.

There are no particular limitations on the thickness of the support in the ink sheet having the support, the cushioning layer and the image receiving layer, and on the thickness of the support in the ink sheet formed of only the support. The thickness of the cushioning layer corresponds to the thickness of the cushioning layer in the ink sheet. The image receiving sheet may usually have a thickness of from 0.1 to 20 μm, which, however, does not necessarily apply to the case where the cushioning layer is used as the image receiving layer.

EXAMPLES

The present invention will be described below in detail by giving Examples. Embodiments of the present invention are by no means limited to these. Examples 1 to 4 relate to the recording material of the present invention, and Examples 5 and 6 to the image receiving material of the present invention.

Example 1

Preparation of Recording Material

Using transparent PET with an elasticity modulus of 450 kg/mm$^2$ and a thickness of 75 μm (polyethylene terephthalate; T-100, available from Diafoil Hoechist Ltd.) as a support, the following intermediate layer was formed thereon in a thickness of 30 μm. As upper layers thereof, a light-heat converting layer and an ink layer were successively provided by coating. Heat mode recording materials were thus prepared. The elasticity modulus was measured using BYBRON DDV-2, manufactured by Orienteck Co., under conditions of applying a strain of 0.02% at 11 Hz. Measurment temperatures were set in the range of from −100° to 100° C., and a storage elasticity modulus at 25° C. measured when temperature was raised at a rate of 2° C./min was regarded as the value of elasticity modulus. With regard to samples that could not be formed into films, a 5 to 10 μm thick layer was formed on a 14 μm thick PET base, and its elasticity modulus was calculated by subtracting that of the PET base later.

| Intermediate layer component | Storage elasticity modulus ($kg/mm^2$) |
|---|---|
| a. Styrene butadiene (JSR0617, available from Japan Synthetic Rubber Co., Ltd. | 30 |
| b. Urethane resin (CROWN BOND U-06, available from Takamatsu Yushi K.K.) | 20 |
| c. Ethylene-acrylic acid resin (HITECK S-3125, available from Toho Chemical Industry Co., Ltd.) | 20 |
| d. Acrylic, resin,,(BR-102, available from Mitsubishi Rayon Co., Ltd.9 | 130 |

Light-heat Converting Layer

On the intermediate layer, a coating solution with the following composition was coated by wire bar coating, followed by drying.

| Light-heat converting layer coating solution | |
|---|---|
| Polyvinyl alcohol (GL-05, available from Nihon Gosei Kako Co., Ltd.) | 7 parts |
| IR absorbing dye IR-1 | 3 parts |
| Distilled water | 90 parts |

IR-1

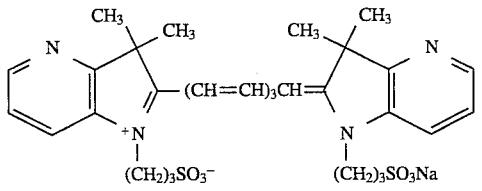

λmax 740 nm (MeOH)

Ink Layer

On the light-heat converting layer, a coating solution with the following composition was coated by wire bar coating, followed by drying.

| Ink layer coating solution | |
|---|---|
| Styrene-acrylic resin (HIMER SBM-100, available from Sanyo Kasei Kogyo Cd.) | 7.4 parts |
| Ethylene-vinyl acetate copolymer (EV-40Y, available from Mitsui Du Pont Polychemicals Co., Ltd.) | 0.5 part |
| Cyan pigment dispersion (available from Mikuni Color Works Ltd.) | 2.5 parts |
| Silicone resin fine particles (TOSPEARL 108, available from Toshiba Silicone Co., Ltd.) | 0.3 part |
| DOP (dioctyl phthalate) | 0.3 part |
| MEK (methyl ethyl ketone) | 90 parts |

Preparation of Heat Mode Recording Material

On the same PET support as used in the recording material, a coating solution with the following composition was coated by wire bar coating, followed by drying. Layer thickness: 1.0 μm.

Image Receiving Layer Coating Solution

| | |
|---|---|
| Ethylene-vinyl acetate copolymer (AD37P295, available from Toyo Morton Co.) | 10 parts |
| Water | 90 parts |

Using the above four kinds of recording materials having different intermediate layer components and the above image receiving material, heat mode transfer was carried out in the following way to evaluate the effect of the intermediate layer.

Opposingly to an optical system comprising a semiconductor laser with a wavelength of 830 nm, set to give a power of 30 mW on the exposure surface and a 1/e2 spot diameter of 10 μm, the recording material and the image receiving material, which were brought into vacuum contact with each other at 400 Torr against the drum type pressure reducing device, were rotated at a linear velocity of 95 cm/second to carry out transfer of a 1 dot line image and a halftone image.

Any irregularity in dot quality of halftone dots in the transferred image was observed. In the samples of the present invention, showing a good contact performance, transfer free from any break-off or slim image of halftone dots and with clear contours was performed.

Example 2

On the same PET support as used in Example 1, the following intermediate layer was formed in a thickness of 30 μm. As upper layers thereof, the same light-heat converting layer and ink layer as those in Example 1 were successively provided by coating. Ink sheets were thus prepared. The glass transition temperature (Tg) was measured using the same apparatus and under the same conditions as those in Example 1. The temperature at which loss elasticity modulus showed a peak was regarded as the Tg.

| Intermediate layer component | Tg (°C.) |
|---|---|
| e. EVA (EVAFLEX 550, available from Mitsui Du Pont Co.) | −35 |
| f. EVA (A709, available from Mitsui Du Pont Co.) | −40 |

-continued

| Intermediate layer component | Tg (°C.) |
|---|---|
| g. 1,2-Polybutadiene (RB820, available from Japan Synthetic Rubber Co., Ltd. | −12 |
| h. Ethylene-acrylic acid resin (HITECK S-3125, available from Toho Chemical Industry Co., Ltd.) | 19 |
| i. Polyester resin (BYRON 200, available from Toyobo Co., Ltd. | 67 |
| j. Polymethyl methacrylate resin | 105 |

Heat mode recording was also carried out on the recording materials of Example 2 in the same manner as in Example 1.

Results obtained are shown below.

| Intermediate layer component | Transferred line width average value (μm) | Irregularity in halftone dot shape | Remarks |
|---|---|---|---|
| a. | 8.5 | None | Y |
| b. | 10.5 | " | " |
| c. | 9.5 | " | " |
| d. | 9.5 | " | " |
| e. | 11.5 | " | " |
| f. | 10.5 | " | " |
| g. | 10.5 | " | " |
| h. | 9.0 | " | " |
| i. | 11.5 | " | " |
| j. | 5.2 | Seen | X |

X: Comparative Example, Y: Present Invention

In the instance in which the component material j was used in the intermediate layer, microscopic observation confirmed that the average area was only 38% with respect to exposure of 50% halftone dots and the halftone dot shape was clearly different from the square exposure pattern.

Example 3

Recording materials were prepared in the same manner as in Example 1 except that polyester resin (BYRON 200, ditto) and EVA resin (EVAFLEX 555, ditto) were used as intermediate layer components and the layer thickness of the intermediate layer was varied as shown below. Heat mode recording was similarly carried out.

Results obtained are shown below.

| Intermediate layer component | Layer thickness (μm) | Transferred line width average value (μm) | Irregularity in halftone dot shape |
|---|---|---|---|
| — | 0 | 2.0 | Seen |
| BYRON 200 | 2 | 3.0 | " |
| " | 4 | 3.5 | " |
| " | 6 | 8.0 | None |
| " | 10 | 9 | " |
| " | 20 | 10.5 | " |
| " | 35 | 11.0 | " |
| " | 50 | 12.0 | " |
| EVAFLEX 550 | 2 | 1.5 | Seen |
| " | 4 | 2.5 | " |

-continued

| Intermediate layer component | Layer thickness (μm) | Transferred line width average value (μm) | Irregularity in halftone dot shape |
|---|---|---|---|
| " | 6 | 7.5 | None |
| " | 10 | 9.0 | " |
| " | 20 | 9.5 | " |
| " | 30 | 11.0 | " |
| " | 50 | 11.5 | " |

Example 4

Recording materials were prepared in the same manner as in Example 1 except that the following components were used as intermediate layer components. Heat mode recording was carried out similarly. The rate of penetration was measured according to JIS K2530-1976. The intermediate layers were all formed in a thickness of 30 μm. Results obtained are shown below.

| Intermediate layer component | Type of component | Penetration | Faulty images at portions with foreign matter Foreign matter size (μm) 10 | 15 | 20 | 30 |
|---|---|---|---|---|---|---|
| 1. EVAFLEX EV47X | EVA | 40 | A | A | A | A |
| 2. EVAFLEX A709 | EVA | 45 | A | A | A | A |
| 3. EVAFLEX A704 | EVA | 21 | A | A | A | B |
| 4. BYRONAL BX1055 | Polyester | 57 | A | A | A | B |
| 5. KALIFLEX TR1117S | SIS | 54 | A | A | A | B |
| 6. KRATON D1320X | SIS | 81 | A | A | A | B |
| 7. EVAFLEX P1007 | EVA | 7 | B | B | C | C** |
| 8. EVAFLEX EV550 | EVA | 10 | B | B | C | C** |

EVAFLEX: Available from Mitsui Du Pont Chemicals Co., Ltd.
BYRONAL: Available from Toyobo Co., Ltd.
KALIFLEX, KRATON: Available from Shell Chemical Co.
*Evaluation was made according to the following criterions.
A: Faulty images occur by less than three times the size of foreign matter.
B: Faulty images occur by less than three to five times the size of foreign matter.
C: Faulty images occur by more than five times the size of foreign matter.
**Comparative Example

Example 5

Preparation of Recording Material

On a 100 μm thick PET (polyethylene terephthalate) support, the following, light-heat converting layer and ink layer were successively provided by coating to produce a recording material. The amounts of components in each layer are all indicated as part(s) by weight.

Light-heat Converting Layer

A coating solution with the following composition was prepared and coated by wire bar coating, followed by drying. The layer was formed in a thickness of 0.3 μm and made to have a light absorbance of 0.9 at 830 nm.

| | |
|---|---|
| Water-soluble light-heat converting material | 3.50 parts |
| GL-50 (polyvinyl alcohol; available from Nihon Gosei Kako Co., Ltd.) | 3.43 parts |
| FT248 (aqueous surface active agent; available from BASF Corp.) | 0.07 part |
| Water | 93 parts |

Ink Layer

A solution with the following composition was dispersed to prepare a coating solution, which was then coated on the above light-heat converting layer by wire bar coating, followed by drying. The layer was formed in a thickness of 0.4 μm and adjusted to have a green density of 0.65 using Sakura Densitometer.

| | |
|---|---|
| DS-90 (available from Harima Chemicals, Inc.) | 4.7 parts |
| SD0012 (available from Toyo Ink Mfg. Co., Ltd.) | 0.5 part |
| EV-40Y (available from Mitsui Du Pont) | 0.5 part |
| DOP (Dioctyl phthalate) | 0.3 part |
| Lyonol Red 6BFC (magenta pigment; available from Toyo Ink Mfg. Co., Ltd.) | 4.0 parts |
| MEK | 90.0 parts |

Preparation of Image Receiving Material

On a 100 μm thick PET support, the following deformable layer and image receiving layer were successively provided by coating to produce image receiving materials. The amounts of components in each layer are all indicated as part(s) by weight.

| Deformable layer component | Elasticity modulus (kg/mm$^2$) |
|---|---|
| 11) EVAFLEX 150 (ethylene-vinyl acetate resin with a vinyl acetate content of 14%; available from Mitsui Du Pont Polychemicals Co.) | 2 |
| 12) JSR-RB830 (polybutadiene resin; available from Japan Synthetic Rubber Co., Ltd.) | 10 |
| 13) EVAFLEX 560 (ethylene-vinyl acetate resin with a vinyl acetate content of 14%; available from Mitsui Du Pont Polychemicals Co.) | 10 |
| 14) CROWN BOND U-60 (Urethane resin; available from Takamatsu Yushi KK.) | 20 |
| 15) HITECK S-3125 (ethylene-acrylic acid resin; available from Toho Chemical Industry Co., Ltd.) | 20 |
| 16) JSR0617 (styrene-butadiene resin; available from Japan Synthetic Rubber Co., Ltd.) | 30 |
| 17) DIANAL BR-102 (acrylic resin; available from Mitsubishi Rayon Co., Ltd.) | 130 |
| 18) STYRON 666 (styrene resin; available from Asahi Chemical Industry Co., Ltd.) | 330 |
| 19) STYRYL 767 (styrene-acrylonitrile resin; available from Asahi Chemical Industry Co., Ltd.) | 350 |

Deformable Layer (a) Deformable layers were provided by coating, using the following components having different elasticity moduli.

Layer thickness: 30 μm.

The elasticity modulus was measured using BYBRON DDV-2, manufactured by Orienteck Co., under conditions of applying a strain of 0.02% at 11 Hz. Measurment temperatures were set in the range of from −100° to 100° C., and a storage elasticity modulus at 25° C. measured when temperature was raised at a rate of 2° C./min was regarded as the value of elasticity modulus. With regard to samples that could not be formed into films, a 5 to 10 μm thick deformable layer was formed by coating on a 14 μm thick PET base, and its elasticity modulus was calculated by subtracting that of the PET base after the elasticity modulus as a whole was measured.

(b) Deformable layers were provided by coating, using the following components having different melt viscosities (at 200° C.). Layer thickness: 30 μm. The melt viscosity was measured using a flow tester manufactured by Shimadzu Corporation under conditions of an orifice diameter of 1 mm, an orifice length of 10 mm, a load of 10 kg/cm$^2$ and 200° C.

| Deformable layer component | Melt viscosity (cp) |
|---|---|
| 20) BYRON GV100 (polyester resin (available from Toyobo Co., Ltd. | 60 |
| 21) BYRON 500 (polyester resin (available from Toyobo Co., Ltd. | 700 |
| 22) BYRON 300 (polyester resin (available from Toyobo Co., Ltd. | 800 |
| 23) BYRON 200 (polyester resin (available from Toyobo Co., Ltd. | 3,000 |
| 24) EP-4969-1W (high melt viscosity ethylene-vinyl acetate resin available from Mitsui Du Pont Polychemicals Co.) | 11,000 |
| 25) EP-4969-2W (high melt viscosity ethylene-vinyl acetate resin available from Mitsui Du Pont Polychemicals Co.) | 20,000 |

(c) Deformable layers were provided by coating, using the following components having different glass transition temperatures. Layer thickness: 30 μm. The glass transition temperature was measured using BYBRON DDV-2, manufactured by Orienteck Co., under conditions of applying a strain of 0.02% at 11 Hz. Measurment temperatures were set in the range of from −100° to 100° C., and a peak temperature of a storage elasticity modulus at 25° C. measured when temperature was raised at a rate of 2° C./min was regarded as the glass transition temperature.

| Deformable layer component | Glass transition temperature (°C.) |
|---|---|
| 26) EVAFLEX A709 (ethylene-ethyl acrylate resin with an ethyl acrylate content of 35%; available from Mitsui Du Pont Polychemicals Co.) | −40 |
| 27) EVAFLEX 55030 ethylene-vinyl acetate resin with a vinyl acetate content of 14%; available from Mitsui Du Pont Polychemicals Co.) | −35 |
| 28) JSR-RB820 (polybutadiene resin; available from Japan Synthetic Rubber Co., Ltd.) | −12 |
| 29) BYRON 500 (polyester resin; available from Toyobo Co., Ltd. | 4 |
| 30) HITECK S-3125 (ethylene-acrylic acid resin; available from Toho Chemical Industry Co., Ltd.) | 19 |
| 31) DIANAL BR-102 (acrylic resin; available from Mitsubishi Rayon Co., Ltd.) | 20 |
| 32) BYRON 103 (polyester resin; available from Toyobo Co., Ltd. | 47 |
| 33) BYRON 200 (polyester resin; available from Toyobo Co., Ltd. | 67 |
| 34) DIANAL BR-75 (acrylic resin; available from Mitsubishi Rayon Co., Ltd.) | 90 |
| 35) DIANAL BR-50 (acrylic resin; available from Mitsubishi Rayon Co., Ltd.) | 100 |
| 36) DIANAL BR-88 (acrylic resin; available from Mitsubishi Rayon Co., Ltd.) | 105 |

Evaluation Method

Opposingly to an optical system capable of concentrating light of a semiconductor laser with a wavelength of 830 nm and set to give a power of 30 mW on the exposure surface and a $1/e^2$ spot diameter of 10 μm, the light-heat converting type heat mode recording material and image receiving material, which were brought into vacuum contact with each other at 400 Torr against the drum, were rotated at a linear velocity of 95 cm/second to carry out transfer. As the pattern of exposure, a line pattern formed by continuous emission of light from the laser and a halftone dot pattern formed by connecting a halftone dot image forming machine separately made ready for use. In samples showing a good contact performance, recorded line width was thick and halftone dots were transferred in a shape faithful to the original shape.

The ink layer imagewise transferred to the image receiving material, after its transmission density at solid areas on the image receiving material had been measured, was further transferred to art paper by passing the image receiving material through rubber rolls of a laminator set to operate under conditions of 3 kg/cm$^2$ and 150° C., putting face-to-face the surface of the image receiving layer of the image receiving material and the art paper. Thereafter, transmission density of the ink remaining on the image receiving material and the shape of halftone dots on the art paper were observed. Results obtained are shown below.

| | On image receiving material | | | On art paper after further transfer | |
|---|---|---|---|---|---|
| Sample No. | Transferred line width | Halftone dot shape | Solid area density | Halftone dot shape | Solid area density |
| 11 (Y) | 11 | Good | 0.62 | Good | 0.01 |
| 12 (Y) | 10 | Good | 0.64 | Good | 0.02 |
| 13 (Y) | 11 | Good | 0.61 | Good | 0.01 |
| 14 (Y) | 10 | Good | 0.60 | Good | 0.01 |
| 15 (Y) | 9 | Good | 0.60 | Good | 0.01 |
| 16 (Y) | 8 | Good | 0.59 | Good | 0.02 |
| 17 (Y) | 6 | Good | 0.55 | Good | 0.03 |
| 18 (X) | 2–3 | Poor | 0.21 | Poor | 0.07 |
| 19 (X) | 2–3 | Poor | 0.18 | Poor | 0.10 |
| 20 (Y) | 10 | Good | 0.62 | Good | 0.01 |
| 21 (Y) | 11 | Good | 0.63 | Good | 0.01 |
| 22 (Y) | 10 | Good | 0.61 | Good | 0.01 |
| 23 (Y) | 10 | Good | 0.60 | Good | 0.02 |
| 24 (X) | 1–2 | Poor | 0.19 | Poor | 0.05 |
| 25 (X) | 2–3 | Poor | 0.15 | Poor | 0.04 |
| 26 (Y) | 10 | Good | 0.61 | Good | 0.01 |
| 27 (Y) | 10 | Good | 0.61 | Good | 0.01 |
| 28 (Y) | 11 | Good | 0.62 | Good | 0.02 |
| 29 (Y) | 10 | Good | 0.60 | Good | 0.01 |
| 30 (Y) | 10 | Good | 0.61 | Good | 0.02 |
| 31 (Y) | 10 | Good | 0.60 | Good | 0.01 |
| 32 (Y) | 9 | Good | 0.59 | Good | 0.03 |
| 33 (Y) | 9 | Good | 0.57 | Good | 0.02 |
| 34 (X) | 2–3 | Poor | 0.12 | Poor | 0.02 |
| 35 (X) | No transfer | — | — | — | — |
| 36 (X) | No transfer | — | — | — | — |

X: Comparative Example, Y: Present Invention

Example 6

A recording material was prepared in the same manner as in Example 5. Heat mode recording was carried out using this recording material and an image receiving material prepared to have a deformable layer varied as shown below. The penetration of the deformable layer was measured in the same manner as in Example 4. Deformable layers were all made to have a layer thickness of 30 μm. Results obtained are shown below.

| Deformable layer component | Type of component | Penetration | Faulty images* at portions with foreign matter Foreign matter size (μm) 10 | 15 | 20 | 30 |
|---|---|---|---|---|---|---|
| 41. KRATON G1657 | SEBS | 20 | A | A | A | B |
| 42. KRATON D1320X | SIS | 81 | A | A | A | A |
| 43. KALIFLEX TR1117S | SIS | 54 | A | A | A | A |
| 44. EVAFLEX EV47X | EVA | 40 | A | A | A | A |
| 45. SOALEX RCH | EVA | 60 | A | A | A | A |
| 46. EVAFLEX P1007 | EVA | 7 | B | B | C | C** |
| 47. EVAFLEX EV550 | EVA | 10 | B | B | C | C** |

KRATON: Available from Shell Chemical Co.
EVAFLEX: Available from Mitsui Du Pont Chemicals Co., Ltd.
SOALEX: Available from Nihon Gosei Kagaku Co.
*Evaluation: In the same manner as in Example 4.
**Comparative Example According to the light-heat converting type heat mode recording material, image receiving material and recording process of the present invention, the vacuum contact can achieve a satisfactory contact, and also makes it possible to perform light-heat converting type heat mode recording that promises a superior transport performance and a good transfer performance and enables high-speed recording.

Example 7

Preparation of Ink Sheet

On a base comprised of a 75 μm thick transparent PET (T-100; polyethylene terephthalate available from Diafoil Hoechist Ltd.) having been laminate-coated with EVA (P1407C, available form Mitsui Du Pont Polychemicals Co., Ltd.) in a thickness of 30 μm, a cushioning layer coating solution, a subbing layer coating solution, a light-heat converting layer coating solution and an ink layer coating solution each having the following composition were successively coated to form an ink sheet. In order to attain surface precision of the laminate coating, a 25 μm thick PET film was laminated to the base, and the base was used after the 25 μm thick PET film was peeled therefrom before the light-heat converting layer was formed. Upon the coating of the following cushioning layer coating solution, the surface precision was 0.2 μm in surface roughness Ra when the standard length was 2.5 mm and the cutoff value was 0.08 mm, and was 2.4 μm in Rmax when the standard length was 2.5 mm and the cut-off value was 8 mm.

In Examples, "part(s)" refers to part(s) by weight of component solid content. (Solvents are as such.)

Cushioning Layer Coating Solution

| | |
|---|---|
| Polyester ((BYRON 200, available from Toyobo Co., Ltd.) | 30 parts |
| Ethyl acetate | 56 parts |
| Toluene | 14 parts |

Coated so as to give a dried coating thickness of 5 μm.

Subbing Layer Coating Solution

| | |
|---|---|
| Polyester (PLUS COAT Z-446, available from Goo Chemical Col., Ltd,) | 5 parts |
| Ethanol | 50 parts |
| Water | 50 parts |

Coated so as to give a dried coating thickness of 0.15 μm.

Light-heat Converting Layer Coating Solution

| | |
|---|---|
| PVA (C506, polyvinyl alcohol available from Kuraray Co., Ltd.) | 3.5 parts |
| IR absorbing dye IR-1 | 3.4 parts |
| Surface active agent (FT248, available from BASF Corp.) | 0.1 part |
| Water | 93.0 parts |

Coated so as to give a light absorbance of 1.0 at 830 nm. The dried layer thickness was about 0.25 82 m.

Ink Layer Coating Solution

| | |
|---|---|
| Magenta pigment MEK dispersion | 40 parts |
| Styrene-acrylate resin (SUPRAPAL WS, available from BASF Corp.) | 48 parts |
| EVA (EV40Y, available from Mitsui Du Pont Polychemicals) | 5 parts |
| DOP (dioctyl phthalate) | 3 parts |
| Fine particles (TOSPEARL 108, available from Toshiba Silicone Co., Ltd.) | 3 parts |
| Surface active agent (S-382, available from Asahi Glass Co., Ltd.) | 1 part |
| MEK (methyl ethyl ketone) | 1,900 parts |
| Cyclohexanone | 100 parts |

Coated so as to give a dried coating thickness of 0.4 μm.

Preparation of Image Receiving Sheet

On a base with a cushioning layer as used in the ink sheet (a base provided by coating with two cushioning layers), an image receiving layer was formed by coating polyester resin (PESRESIN S230, available from Takamatsu Yushi K.K.) so as to give a dried coating thickness of 1 μm.

Thermal Transfer

The ink layer of the above ink sheet and the image receiving layer of the image receiving sheet were put face-to-face and wound around the drum, which were then brought into vacuum contact at 200 Torr, followed by exposure to semiconductor laser light with an oscillation wavelength of 830 nm from the back of the ink sheet under conditions of 33 mW and $1/e^2$ of 6 μm on the exposure surface. At sensitivity 200 $mJ/mm^2$, it was possible to perform transfer without uneven line width.

Example 8

Preparation of Ink Sheet

On Nisshinbo synthetic paper (PEACH COAT WE110, available from Nisshinbo Industries, Inc.), a cushioning layer coating solution, a light-heat converting layer coating solution and an ink layer coating solution each having the following composition were successively coated to form an ink sheet.

Upon the coating of the cushioning layer coating solution on PEACH COAT WE110, the surface precision was 0.2 μm in surface roughness Ra when the standard length was 2.5 mm and the cut-off value was 0.08 mm, and was 1.2 μm in Rmax when the standard length was 2.5 mm and the cut-off value was 8 mm.

In Examples, "part(s)" refers to part(s) by weight of component solid content. (Solvents are as such.)

Cushioning Layer Coating Solution

| | |
|---|---|
| Polyester (PLUS COAT Z-802, available from Goo Chemical Col., Ltd,) | 25 parts |
| Water | 75 parts |

Coated so as to give a dried coating thickness of 5 μm.

The light-heat converting layer and the ink layer were formed in the same manner as in Example 7.

As an image receiving sheet, the same sheet as in Example 7 was used.

Thermal Transfer

Carried out in the same manner as in Example 7 except that exposure was applied from the back of the image receiving sheet. At sensitivity 200 mJ/mm$^2$, it was possible to perform transfer without uneven line width.

Example 9

Preparation of Image Receiving Sheet

On Nisshinbo synthetic paper (PEACH COAT WE110, available from Nisshinbo Industries, Inc.), a cushioning layer coating solution and an image receiving layer coating solution shown below were successively coated to form an image receiving sheet. In Examples, "part(s)" refers to part(s) by weight of component solid content.

Cushioning Layer Coating Solution

| | |
|---|---|
| Polyester (PESRESIN A1243, available from Takamatsu Yushi K.K.) | 3 parts |
| Polyvinyl alcohol (GOSENOL GL-05, available from Nihon Gosei Kako Co., Ltd.) | 7 parts |
| Water | 90 parts |

Coated so as to give a dried coating thickness of 2 μm.

Image Receiving Layer Coating Solution

| | |
|---|---|
| Styrene-acrylate (HIMER SBM100, available from Sanyo Kasei Co.) | 3 parts |
| Vinyl chloride graft EVA (GRAFTMER E, available from Nippon Zeon Co., Ltd.) | 2 parts |
| Methyl ethyl ketone | 57 parts |
| Cyclohexanone | 38 parts |

Coated so as to give a dried coating thickness of 3 μm.

The surface precision was 0.2 μm in surface roughness Ra when the standard length was 2.5 mm and the cut-off value was 0.08 mm, and was 1.2 μm in Rmax when the standard length was 2.5 mm and the cut-off value was 8 mm.

Thermal Transfer

Carried out in the same manner as in Example 7. As a result, at sensitivity 180 mJ/mm$^2$, it was possible to perform transfer without uneven line width. The image thus obtained was put face-to-face to printing paper (Mitsubishi ingrain art paper), and further transferred thereto at a laminate temperature of 150° C. As a result, it was possible to transfer the ink on the image receiving layer by 100% together with the image receiving layer in the state of interfacial separation.

Comparative Example 1

Preparation of Ink Sheet

On a base comprised of a 75 μm thick transparent PET (T-100; polyethylene terephthalate available from Diafoil Hoechist Ltd.) having been laminate-coated with EVA (P1407C, available form Mitsui Du Pont Polychemicals Co., Ltd.) in a thickness of 30 μm, the subbing layer coating solution, the light-heat converting layer coating solution and the ink layer coating solution each having the composition as shown in Example 7 were successively coated to form an ink sheet. In order to attain surface precision of the laminate coating, a 25 μm thick PET film was laminated to the base, and the base was used after the 25 μm thick PET film was peeled therefrom before the light-heat converting layer was formed. The surface precision on the surface of the laminate coating was 0.8 μm in surface roughness Ra when the standard length was 2.5 mm and the cut-off value was 0.08 mm, and was 3.5 μm in Rmax when the standard length was 2.5 mm and the cut-off value was 8 mm.

Thermal Transfer

Using the above ink sheet and the image receiving sheet prepared in Example 7, exposure was carried out in the same manner as in Example 7. As a result, uneveness occurred in line width and irregularity was seen in sensitivity. Solid transfer was also carried out by scanning exposure, whereupon uneven density due to laminate non-uniformity was caused when the the rotational speed of the drum was increased.

Example 10

Preparation of Ink Sheet

On a base comprised of a 75 μm thick transparent PET (T-100; polyethylene terephthalate available from Diafoil Hoechist Ltd.), a cushioning layer coating solution, a intermediate layer coating solution, a light-heat converting layer coating solution and an ink layer coating solution each having the following composition were successively coated to form an ink sheet. The solutions were coated by wire bar coating. In the following, "part(s)" refers to part(s) by weight of component solid content. (Solvents are as such.)

Cushioning Layer Coating Solution

| | |
|---|---|
| Polyester (BYRON 200, available from Toyobo Co., Ltd.) | 30 parts |
| Surface active agent (FC-431, available from Sumitomo 3M Limited.) | 0.3 part |
| Ethyl acetate | 56 parts |
| Toluene | 14 parts |

Coated so as to give a dried coating thickness of 5 μm.

Intermediate Layer Coating Solution

| | |
|---|---|
| Polyester (PLUS COAT Z-446, available from Goo Chemical Col., Ltd,) | 5 parts |
| Ethanol | 50 parts |
| Water | 50 parts |

Coated so as to give a dried coating thickness of 0.15 μm.

Light-heat Converting Layer Coating Solution

| | |
|---|---|
| Gelatin | 64 parts |
| Saponin | 3 parts |
| Citric acid | 0.5 part |
| Glyoxal (hardening agent) | 0.3 part |
| Sodium acetate | 3 parts |
| IR absorbing dye IR-1 | 30 parts |
| Water | 93.0 parts |

IR-1

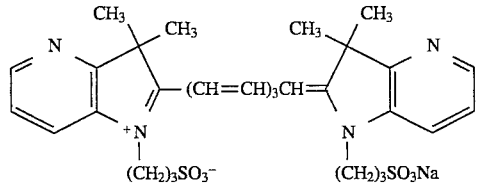

λmax 740 nm (MeOH)

This solution was coated so as to give a light absorbance of 1.0 at 830 nm. The dried layer thickness was about 0.25 μm.

Ink Layer Coating Solution

| | |
|---|---|
| Magenta pigment MEK dispersion | 40 parts |
| Styrene-acrylate resin (SBM100, available from Sanyo Kasei Co.) | 48 parts |
| EVA (EV40Y, available from Mitsui Du Pont Polychemicals Co., Ltd.) | 5 parts |
| DOP (dioctyl phthalate) | 3 parts |
| Fine particles (TOSPEARL 108, available from Toshiba Silicone Co., Ltd.) | 3 parts |
| Surface active agent (S-382, available from Asahi Glass Co., Ltd.) | 1 part |
| MEK (methyl ethyl ketone) | 1,900 parts |
| Cyclohexanone | 100 parts |

Coated so as to give a dried coating thickness of 0.4 μm.

Preparation of Image Receiving Sheet

On a base comprised of a 75 μm thick transparent PET (T-100; ditto) having been laminate-coated with EVA (P1407C, ditto) in a thickness of 30 μm, an image receiving layer coating solution with the following composition was coated so as to give a dried coating thickness of 1 μm. An image receiving sheet was thus prepared.

Image Receiving Layer Coating Solution

| | |
|---|---|
| Styrene-acrylate resin (SBM100, available from Sanyo Kasei Co.) | 92 parts |
| EVA (EV40Y, available from Mitsui Du Pont Polychemicals Co., Ltd.) | 5 parts |
| Fine particles (TOSPEARL 108, available from Toshiba Silicone Co., Ltd.) | 3 parts |

-continued

| | |
|---|---|
| MEK (methyl ethyl ketone) | 700 parts |
| Cyclohexanone | 200 parts |

Thermal Transfer

The ink layer of the above ink sheet and the image receiving layer of the image receiving sheet were put face-to-face and the sheets were wound around the drum, which were then brought into vacuum contact at 200 Torr, followed by exposure to semiconductor laser light with an oscillation wavelength of 830 nm under conditions of 33 mW and $1/e^2$ of 6 μm on the exposure surface. Then the ink sheet was peeled from the image receiving sheet. As a result, at sensitivity 200 mJ/cm$^2$, it was possible to perform transfer. This images was free from adhesion of the light-heat converting layer and entirely free from color turbidity. This image was further transferred to art pater at a laminate temperature of 150° C. As a result, it was possible to transfer it together with the image receiving layer.

Comparative Example 2

Example 10 was repeated except that the intermediate layer was not provided. As a result, there was little change in sensitivity, but, because of non-uniformity of the image receiving layer cushioning layer, portions showing a poor contact performance with respect to the ink sheet and portions having a strong laser light intensity (the beam center) caused scattering of the light-heat converting layer to cause color turbidity. When the ink sheet was peeled from the image receiving layer, it was non-uniformly separated, so that the light-heat converting layer was separated from the cushioning layer to cause color turbidity.

What is claimed is:

1. A light-heat converting heat mode recording process comprising the steps of:

(a) contacting a recording material with an image receiving material by reducing a pressure, said recording material comprising a support having provided thereon, in order, a deformable layer having a thickness of at least 5 μm, a light-heat converting layer, and an ink layer containing a colorant and at least one substance selected from the group consisting of thermomelting substances, thermosoftening substances and thermoplastic resins;

said image receiving material comprising an image receiving layer; a surface of said ink layer and a surface of said image receiving layer being in contact, said ink layer or said image receiving layer containing a matting agent;

(b) exposing said recording material to light corresponding with image information; and (c) transferring a portion of said ink layer corresponding to said image information from said recording material to said image receiving material to produce an ink image on said image-receiving layer of said image receiving material.

2. The process of claim 1 wherein the particle diameter of said matting agent is 0.8 to 1.5 μm, and the amount of matting agent is 15 to 150 mg/m$^2$.

3. The process of claim 1 wherein the particle diameter of said matting agent is 0.2 to 3.5 μm, and the amount of said matting agent is 15 to 150 mg/m$^2$.

4. The process of claim 1 wherein the particle diameter of said matting agent is 5 μm, and the amount of said matting agent is not more than 10 $mg/m^2$.

5. The process of claim 1 wherein said light-heat converting layer has a thickness of 0.1 to 3 μm.

6. The process of claim 1 wherein said light-heat converting layer has an absorption of at least 0.25 with respect to the wavelength of a light source of 700 to 1,000 nm.

7. The process of claim 1 wherein said image-receiving layer has a thickness of 0.5 to 10 μm.

8. The process of claim 1 wherein said image-receiving layer contains at least one resin selected from the group consisting of polyethylene, polypropylene, ethylene-vinyl chloride copolymers, ethylene acrylate copolymers, ethylene-vinyl acetate resins, vinyl chloride graft EVA resins, vinyl chloride graft EVA resins, and vinyl chloride resins.

9. The light-heat converting type heat mode recording process of claim 1, wherein said deformable layer has a glass transition temperature of 80° C. or below.

10. The light-heat converting type heat mode recording process of claim 1, wherein said deformable layer has a penetration of 15 or more.

11. The light-heat converting type heat mode recording process of claim 1, wherein said deformable layer of said recording material has an elasticity modulus of 250 $kg/mm^2$ or less at 25° C.

12. The light-heat converting type heat mode recording process of claim 1, wherein said image receiving material has a colorant capable of absorbing heat.

* * * * *